United States Patent [19]

Lambrecht et al.

[11] Patent Number: 5,019,323

[45] Date of Patent: May 28, 1991

[54] METHOD OF PRODUCING IODINE-124 AND META-IODOBENZYLGUANIDINE CONTAINING IODINE-124

[75] Inventors: Richard M. Lambrecht; Muhammad A. Qureshi; Munawwar Sajjad, all of Riyadh, Saudi Arabia

[73] Assignee: King Faisal Specialist Hospital and Research Centre, Riyahd, Saudi Arabia

[21] Appl. No.: 318,492

[22] Filed: Mar. 2, 1989

Related U.S. Application Data

[63] Continuation-in-part of Ser. No. 42,129, Apr. 24, 1987, abandoned.

[51] Int. Cl.[5] ..... G21G 1/10

[52] U.S. Cl. ..... 376/201; 376/199

[58] Field of Search ..... 376/195, 198, 199, 201, 376/202

[56] References Cited

U.S. PATENT DOCUMENTS

| | | | |
|---|---|---|---|
| 2,504,585 | 4/1950 | Reid . | |
| 3,955,093 | 5/1976 | Quinby . | |
| 4,088,532 | 5/1978 | Blue . | |
| 4,681,727 | 7/1987 | Mirzadeh et al. | 376/198 |

OTHER PUBLICATIONS

Int. J. Appl. Rad. Isot., vol. 26, 1975, pp. 741–747, Acerbi et al.

Int. J. Appl. Rad. Isot., vol. 22, 1971, pp. 481–483.

Int. J. Appl. Rad. Isot., vol. 24, 1973, pp. 651–655.

Int. J. Appl. Rad. Isot., vol. 28, 1977, pp. 395–401, Kondo et al.

Int. J. Appl. Rad. Isot., vol. 28, 1977, pp. 255–261, Bosch et al.

Int. J. Appl. Rad. Isot., vol. 25, 1974, pp. 535–543, Weinreich et al.

Radiochem. Radioanal-Letters, vol. 47, No. 3, 1981, pp. 151–156, Beyer et al.

J. of Nuclear Medicine, vol. 14, No. 5, 1973, pp. 269–273, Lambrecht et al.

Kondo et al., "Cyclotron Isotopes and Radiopharmaceuticals-XXII. Improved Targetry and Radiochemistry for Production of $^{123}I$ and $^{124}I$", International Journal of Applied Radiation and Isotopes, 1977, vol. 28, pp. 765–771.

"Proceedings of a Colloquim on Diagnostic Applications of $^{123}I$-Amphetamine", von Schulthess, Editor, (Weinreich, 1983).

"Radioaktive Isotope in Klinik und Forschung", von Rudolf Hofer, Editor, (Weinreich, 1984).

van Doremalen et al., "A Rapid and High-Yield Aqueous Phase Preparation Procedure for $^{123}I$-Labelled Meta-Iodobenzylguanidine", J. Radioanal. Nucl. Chem., Letters, 96/2/97–104/1985/.

Weiland et al., "Radiolabeled Adrenergic Neuron--Blocking Agents: Adrenomedularry Imaging with $^{131}I$ Iodobenzylguanidine", The Journal of Nuclear Medicine, vol. 21, No. 4, pp. 349–353.

*Primary Examiner*—Charles T. Jordan
*Assistant Examiner*—Richard W. Wendtland
*Attorney, Agent, or Firm*—Baker & McKenzie

[57] ABSTRACT

This invention relates to a method for synthesizing Iodine-124 and also a class of radiopharmaceutical which, by virtue of an Iodine-124 label, can be used for both diagnostic and therapeutic purposes. The method comprises an innovative technique for preparing an irradiation target, irradiating the prepared target, and finally collecting Iodine-124 created by the irradiation. The method of this invention provides Iodine-124 in sufficient yields and radionuclidic purity that can be used with positron emission tomography. The invention further relates to the use of Iodine-124 in a chemical form incorporated into organic and inorganic radiopharmaceuticals.

15 Claims, 1 Drawing Sheet

METHOD OF PRODUCING IODINE-124 AND META-IODOBENZYLGUANIDINE CONTAINING IODINE-124

This application is a continuation-in-part of U.S. Pat. Application Ser. No. 042,129, filed April 24, 1987, now abandoned.

FIELD OF THE INVENTION

This invention relates generally to a process and method for producing and using radiochemicals. More specifically, the method and process of this invention are directed to the preparation of Iodine-124 having high radiochemical and radionuclidic purity, and also to the preparation of radiopharmaceuticals, such as monoclonal and polyclonal antibodies, labeled proteins, natural products and hormones, which by virtue of an Iodine-124 label can be used for both diagnostic and therapeutic purposes, and as a radioactive standard for calibration purposes.

BACKGROUND OF THE INVENTION

Iodine-123 and Iodine-131 radioisotopes are presently used in medical diagnosis and radiation therapy. Metaiodobenzylguanidine sulfate labelled with Iodine-123 and Iodine-131 has been used clinically in the diagnosis and treatment of pheochromocytomas, neuroblastomas and other paragangliomas.

For many years, Iodine-124 was considered to be a troublesome radiocontaminant which increased the absorbed radiation dose of the patient and detracted from the otherwise high quality scintigraphs that could be obtained with high purity Iodine-123 However, Iodine-124 decays by positron emission and can therefore be used in positron emission tomography ("PET"), a recently developed state-of-the-art technology, and Iodine-124 can thereby be used for non-invasive quantitative physiological studies. For example, when metaiodobenzylguanidine (m-IBG) is labelled with Iodine-124 (Iodine-124-m-IBG), it is useful in obtaining quantitative images of the brain, adrenal, and myocardium when used in conjunction with PET technology.

Iodine-124 has a physical halflife of about 4.16 days. This isotope provides medically useful positron nuclear emissions of about 25 per 100 nuclear decay events of Iodine-124. The positrons, which have a maximum end point energy of 2.1 MeV, interact with matter and annihilate into two photons of about 511 keV energy at about 180 degree referenced to the point of annihilation. The annihilation quanta are readily detected by PET instruments.

Mathematical methods can be used to reconstruct the volume element in which the radioactive decay process occurred Since the volume element in which the Iodine-124 decayed can be defined with mathematical models, it is possible to quantitatively measure regional physiological parameters, such as blood flow, metabolism, tissue pH, and receptor specific interactions.

Since radioactivity can be quantitated within a given number of pixels (volume elements), it is possible to define the size and shape of the profile of distribution of Iodine-124. This enables a more accurate staging of the appropriate therapeutic dose of internal delivered radioactivity applied for patient treatment.

A radioactive iodine (radioiodide) isotope in conventional use is Iodine-131 with a halflife of about 8.1 days and which decays be emission of beta particles and various gamma emissions. The beta radiation is utilized in therapy, such as when Iodine-131 iodide is used for the treatment of thyroid carcinoma. The radiation dose delivered from Iodine-124 is approximately 69% of that delivered by the Iodine-131 radionuclide generally used in internal radiotherapeutic applications.

For conventional diagnostic tests, an ideal radioiodide isotope is Iodine-123, which has a physical halflife of 13.1 hours and decays by a high abundance of 159 keV gamma rays. The absorbed radiation dose per unit of the injected dose of "pure" Iodine-123 is 1/100th of the radiation dose associated with Iodine-131.

Iodine-121 and Iodine-122 have been suggested as appropriate medical radiohalogens. However, both are limited by the physical halflife of 2.1 hour and 3.5 minutes, respectively, compared to 4.12 day halflife of Iodine-124

Certain iodinated radiopharmaceuticals require a radio-isotopic label with minimum halflife of 0.5 to 1.0 days. Iodine-124 is therefore an important radiohalogen. The major problem encountered in the application of Iodine-124 to PET has been obtaining the Iodine-124 in sufficient production yields an radionuclidic purities.

A known method of producing Iodine-124 is by Tellurium-124(p,n)Iodine-124 reaction, disclosed in Kondo et al., 28 Int. J. App. Rad. and Isotopes 765 (1977). However, this reaction is not efficient and typically results in low yields.

Consequently, an object of this invention is to provide a method of obtaining Iodine-124 having sufficient production yield and radionuclidic purity for use with PET instrumentation.

A further object of this invention is to provide a method for producing Iodine-124 at levels appropriate for commercial sales, either as a precursor or as a labelled pharmaceutical.

A further object of this invention is to provide a method of producing Iodine-124 with consistent purity so that it can be used as a radioactive standard for calibration of radiologic equipment.

A further object of this invention is to provide a method of producing Iodine-124 which is safe and reliable.

Other objects and features of this invention will become apparent to those skilled in the art after reviewing the following specification.

SUMMARY OF THE INVENTION

This invention relates to a method of obtaining Iodine-124 in sufficient production yields and radiochemical and radionuclidic purity so that it can be used in conjunction with PET instrumentation. The method of this invention is further directed to the production and purification of Iodine-124 at levels appropriate for commercial sales either as a labelled radiopharmaceutical or precursors in the preparation of radiopharmaceuticals. The method results in Iodine-124 (in iodide radiochemical form) that is not appreciably subject to autoradiolytic decomposition even in the absence of reducing agents such as sodium thiosulfate or ascorbic acid.

DISCLOSURE OF THE PREFERRED EMBODIMENT

A. Preparation of Tellurium-124 Targets

Figure 1:
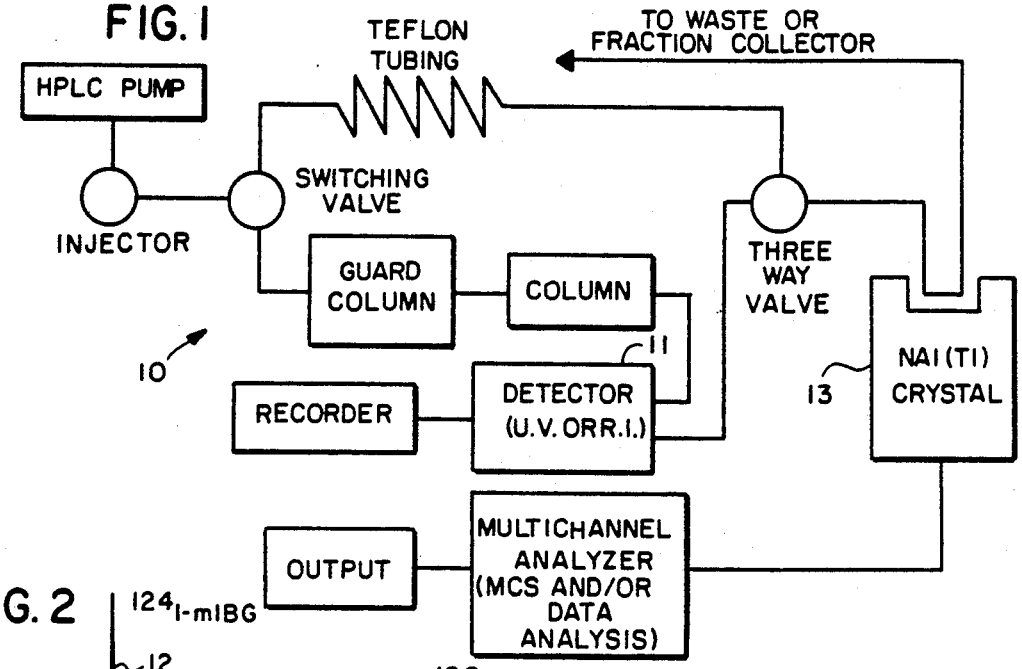
FIG. 1 is a diagram of the High Pressure Liquid Chromatograph system used to prepare solutions in accordance with the invention.
Figure 2:
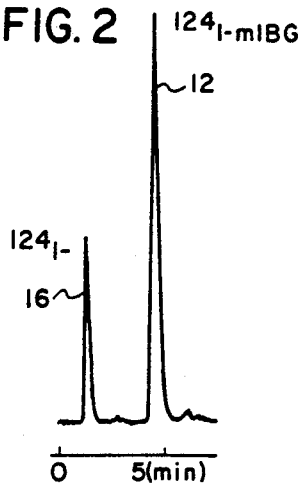
FIGS. 2 and 3 are a pair of graphs which represent sample readouts of the high pressure liquid chromatography system used to analyze radiopharmaceuticals prepared in accordance with the present invention.

In synthesizing Iodine-124, a copper metal plate is first milled and uniformly lapped to the dimensional specifications required for ultimately placing the target matrix in the accelerated deuteron particle path of a nuclear accelerator apparatus, such as a cyclotron. The surface of the copper plate is sanded, washed with distilled water, and dried. The copper plate is then placed in a nickel plating solution prepared from a salt, such as nickel sulfate hexahydrate, and is then electroplated using a platinum electrode as the anode.

The nickel plated, copper plate is then placed in a tellurium plating solution comprising isotopically enriched Tellurium-124 dioxide dissolved in a solution of potassium hydroxide. The tellurium is electroplated onto the nickel plated copper plate using a platinum electrode while the plate is water cooled. The target thickness of the Tellurium-124 is typically 10 to 14 mg/cm$^2$ for routine production targets, and generally must be at least 0.1 mg/cm$^2$ Enriched Tellurium-124 is most preferably plated in the quantity of about 13 mg/cm$^2$ on the nickel plated copper target. These targets are then irradiated in the internal beam line of a Cyclotron. The current is varied from 25 to 80 microamperes, and the irradiation time is varied from 4 to 8 hours.

B. Radiochemical Processing the Iodine-124

After irradiating the Tellurium-124 with deuterons by means of the internal beam line of a cyclotron, the irradiated Tellurium-124 is dissolved from the copper plate by means of a sodium hydroxide solution, with equal volumes of 30% $H_2O_2$, and 5 molar NaOH, plus sufficient deionized $H_2O$ to cover the electrodeposited Tellurium-124.

The dissolution converts most of the $^{124}I$ to $^{124}IO_3$ and $^{124}IO_4$; whereas, most $^{124}Te$ was converted to $^{124}Te+4$ (Eqs.1-2).

(Eq. 1)
$$^{124}Te^{\circ}+2NaOH+3H_2O_2={}^{124}TeO_4+4\text{-}H_2O+2Na+$$

(Eq. 2)
$$^{124}I^{-}+2NaOH+H_2O_2={}^{124}IO_3+2Na++H_2O$$

Following dissolution, the solution and water rinse was transferred to a 250 ML round bottom flask containing 250 mg of Al Powder. The Al promotes the Iodine-124 to be converted to the iodide ($I^-$) form which is required for subsequent medical uses. The flask was gently heated until the $H_2O_2$ was decomposed and Tellurium-124 precipitated.

(Eq.3) $^{124}IO_3+2Al+OH^-={}^{124}I^-+2AlO_3+H_2$ (Eq.4) $^{124}TeO_4+3Al+2OH={}^{124}Te^{\circ}+3AlO_2+H_2$ (Eq.5) $^{124}Te^{\circ}+Al+2OH^-={}^{124}Te^{-2}+AlO^2+H_2$ Occasionally, a dark violet coloration was observed due to the formation of telluride (Eq. 5). A five minute purge of air through the solution oxidizes telluride to Te°. A purge of $CO_2$ for five minutes converts sodium aluminate to aluminum hydroxide (Eqs. 6-7). The final volume was adjusted to specific needs before the Iodine-124 solution was passed through a fine glass filter. The precipitated Tellurium-124 and sodium aluminate was retained in the filter.

(Eq. 6) $2^{124}Te^{-2}+O_2+2H_2O=2Te^{\circ}+4OH^-$ (Eq. 7) $AlO_2+CO_2+2H_2O=Al(OH)_3+HCO_3$ The solution was predominantly $^{124}I^-$ at pH~8.5 buffered by bicarbonate formed during the process of $CO_2$ addition to form the soluble $Al(OH)_3$.

Table 1 illustrates Iodine-124 production yields and levels of Iodine-126 impurity 48 hours after irradiation of the Tellurium-124 target of greater than 95% isotopic enrichment.

TABLE I

| Iodine-124 Production Yield Data | | | | | |
|---|---|---|---|---|---|
| Dose, mAh | Fluence, A | mCi/Ah | $^{124}I$ mCi (EOB) | $^{126}I$ mCi (EOB) | $^{124}I$ (%) (after 48 hours) |
| 100 | 25 | 0.56 | 57.0 | 0.5 | 99.1 |
| 200 | 25 | 0.60 | 119.0 | 0.6 | 99.5 |
| 240 | 40 | 0.52 | 124.0 | 0.7 | 99.4 |
| 250 | 50 | 0.57 | 143.0 | 0.5 | 99.6 |
| 300 | 60 | 0.59 | 150.0 | 0.6 | 99.6 |
| 500 | 75 | 0.48 | 260.0 | <1.2 | 99.5 |
| 210 | 70 | 0.44 | 93.7 | <0.65 | 99.3 |
| 325 | 65 | 0.62 | 210.0 | <1.3 | 99.3 |
| 500 | 80 | 0.54 | 269.66 | <1.83 | 99.3 |

Radioanalysis by gamma-ray spectrometry was performed to assess the radionuclidic purity and to identify the impurities. Irradiation conditions in the examples range from 25 to 85 microampere deuteron beam current, with irradiation doses ranging from 100 to 550 microampere hours. The production yield of Iodine-124 was directly proportional to the dose. The current could be increased to 85 micro-amperes without damaging the target.

Iodine-124 was prepared in quantities of greater than 100 mCi by 15 MeV deuteron irradiation of isotopically enriched Tellurium-124 and the Tellurium-124 (d,2n) Iodine-124 nuclear reaction. The threshold deuteron energy for the nuclear reaction is about 6.5 MeV.

For synthesis of labelled organic molecules, the Iodine-124 and iodine mixture was passed through a cation-exchange column to remove salts and trace metals.

C. Removal of Salts from Iodine-124 Solution

Figure 4:
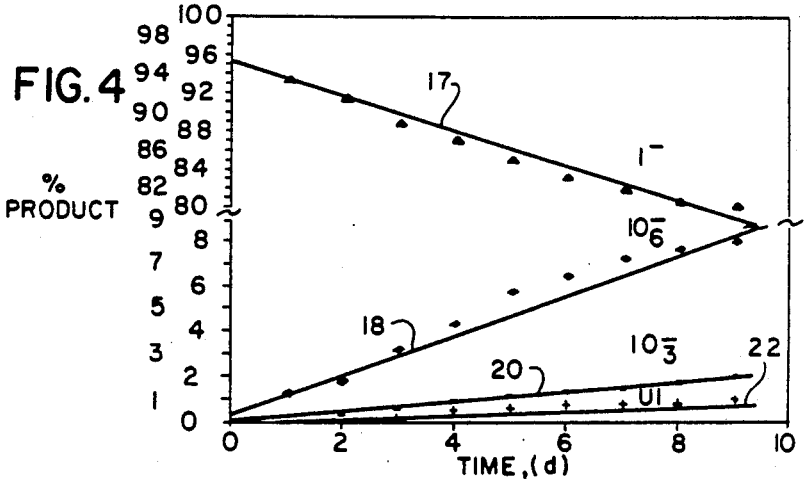
FIGS. 4 and 5 are graphs which show the rate of autoradiolytic decomposition of solutions containing Iodine-124 before and after the removal of salts in accordance with the present invention.
Figure 3:
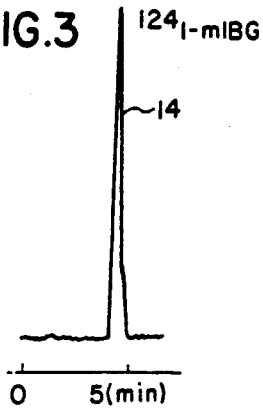
Figure 5:
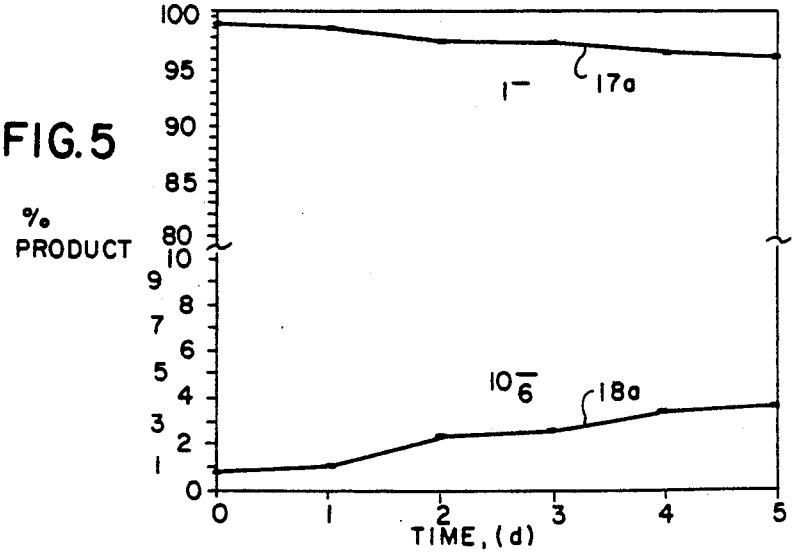

It is important in order to label many organic compounds such as proteins, monoclonal antibodies, and natural products, that the labeling solutions be as chemically pure as possible. Only the radiochemically pure form ($I^-$) of Iodide is used in the labeling of radiopharmaceuticals. The presence of salts and reducing agents interferes with labeling methods used by those skilled in the art. It should be noted that with the method of the present invention, the use of reducing agents is not required. However, removal of deleterious salts greatly decreases the rate of autoradiolytic decomposition of the solutions. If the salts are not removed, the radiochemical composition of the high specific activity Iodine-124 solutions changes with time. In FIG. 4, the upper line 17 shows the rate of autoradiolytic decomposition of Iodine-124 and the lower lines 18, 20 and 22 show the increasing presence of unwanted iodate radiochemical forms of Iodine-124, $IO^-_6$, $IO^-_3$, and UI, UI being an unidentifiable radioactive species FIG. 5 shows a slower rate of decomposition of Iodine-124 after removal of salts from the solution Line 17a represents the improved rate of decomposition of Iodine-124, and line 18a shows the decreased rate of formation of the products of decomposition.

An effective method for removal of the deleterious salts from solutions containing Iodine-124 has been found without the reasons for its effectiveness being completely understood. The procedure is as follows:

Fill a column (about 1.5×50 cm) with a Chelex-100 resin to a level of about 20 cm. The resin should be prepared beforehand by placing it in a beaker and covering it with water for at least 12 hours. The column should then be washed with water. Then, 150 ml. of 7.0 M HCl should be passed through the column, followed by a water washing such that the eluant has a pH of approximately 7.0. It is important to maintain a neutral pH, and the pH should be checked. Excess water should be drained and the column should be closed to prevent drying of the resin.

In a beaker, place 1 ml. of 0.1M NaOH, and place it under the column containing the resin. Then, pour the iodine solution containing salts into the column and allow it to drain through the column. The column used should be washed to remove most of the radioactivity.

The solution is then heated to remove excess water so that its concentration is about 15 to 120 mCi per 1.0 ml.

D. Production of ($I^{124}$)-m-IBG

As way of example, the following is a discussion of Iodine-124 being incorporated in meta-iodobenzylguanidine (m-IBG). ($I^{124}$)-m-IBG is one example of a radiopharmaceutical which can be used to provide either diagnosis or therapy using PET instrumentation.

Non-radioactive m-IBG was synthesized by the method of Wieland, disclosed in Wieland et al., 21 Journal of Nuclear Medicine 349 (1980). The m-IBG was characterized on a Nicolet Model 5DX IR: (KBr) showed broad peaks between 3100 to 3448 ($NH_2$,NH), 1600(C=N), 1590 (aromatic C=C), 772 & 687 cm $^{-1}$ (m-disubstituted phenyl). Mass spectroscopy analysis (direct probe insertion) was performed on a Finnegan MAT Model-311 : molecular ion (M+) and a base peak (rel. intensity 100%) at m/z 276, a peak (relative intensity 060%) at m/z 233 (M-43) representing the split of the —C group. Proton NMR analysis was performed on a Varian Model T-60A : (DMSO-d6); delta 7 to 7.8 (m,4H aromatic), the benzylic $CH_2$ group is overmasked by the water peak at delta 3.4. Melting point: 167.3 degrees centigrade (corrected); literature: 167.0 degrees centigrade (uncorrected).

The exchange reaction to prepare ($I^{124}$)-m-IBG was adopted with a modification from the method of Van Doremalen, et al., 96 J. Radioanal. Nucl. Chem., Letters., 97 (1985). In a 10 ml borosilicate serum vial 2.7 micro-moles of "cold" metaiodobenzylgaunidine sulphate was mixed with 6.2 micro-moles of $Cu(NO_3)_2$. Iodine-124 (5 to 20 mCi) was added. The total volume was brought to approximately 0 8 ml. with water, and the mixture was then adjusted to pH 5. The vessel was stoppered and heated to 150 degrees centigrade in an oil bath for 45 minutes Upon cooling, 1.5 mL of 2.45% sodium biphosphate buffer solution was added to precipitate copper. Copper phosphate precipitate was then removed by filtering through 0.22 micron millipore filter. The filtrate was passed through 100 to 200 mesh Bio-Rad AGI-X8 anion-exchange resin to remove the unreacted iodide.

Incorporation of Iodine-124 into m-IBG was accomplished in a radiochemical yield of 70 to 90%. HPLC analysis of the filtrate after removal of copper phosphate precipitate (see FIG. 1) indicated the presence of unreacted iodide and occasionally the unprecipitated copper. However, a careful passage of the filtrate through a Bio-Rad anion-exchange resin completely removed the Iodine-124, rendering the filtrate greater than 95% radiochemically pure (see Table 1 above). Complete precipitation of copper was ensured by adjustment of the pH and concentration of the phosphate buffer. With this modification, the final preparation contained less than 1 micro-gram/ml of copper by wet chemical analysis.

Alternatively, m-IBG labeled with Iodine-124 can be produced when Iodine-124 having high chemical purity is used in a procedure whereby reaction mixtures are passed through a Waters octadecyl "Sep-Pak" cartridge while the cartridge is purged with water to remove the inorganic chemical forms of sulphate and Iodine-124. The labelled m-IBG is removed from the cartridge with 5 ml. of ethanol followed by rapid concentration in a stream of air. Reconstitution for injection follows by the addition of isotonic saline.

Another example of the use of radionuclidicly pure Iodine-124 is in the labeling of the B-HCG polyclonal antibody, which can be used to locate choriocarcinoma, which is very difficult to diagnose by other conventional methods.

E. Chromatography

Chromatographic and radiochemical procedures were applied to obtain greater than 95% Iodine-124 activity in iodide anion form for further radiochemical synthesis. Sodium Iodine-124 solution was analyzed by thin layer chromatography (TLC) using SG ITLC, available from Gelman Instrument Co., USA. The developing solvent was the organic phased prepared by mixing 3 ml. of $NH_4OH$ in 12 ml. of 1-butanol; $R_f$ values: $I^-$: 0.8; $IO_3^-$ and other radiochemical impurities: 0.0 to 0.15. ($I^{124}$)-m-IBG was analyzed by TLC on silica gel plates with ethylacetate: ethanol: $H_2O$ (20:20:1) as the developing solvent (Rf, $I^-$: 0.75; $I^{124}$-mIBG:0.00). High pressure liquid chromatography (HPLC) analysis of m-IBG was performed on a Varian 5000 HPLC System. Column effluent was passed first through a variable UV detector (254nm), and then through a radioactivity detector (NaI) connected in series with the UV detector as shown in FIG. 1.

Analysis of m-IBG was performed on an Altech C-18, 10 micron column. The column was eluted with an eluate composed of 60% 0.05M $NH_4H_2PO_4$ and 40% $CH_3CN$, at a flow rate of 2mL/minute. Retention time for m-IBG was 4.68 minutes while the unbound Iodine-124 and/or $Cu^{+2}$ eluted with the solvent front.

Analysis of Iodine-124 iodide ($I^-$) was performed on RP 18 Lichorsorb 4.6×250 mm column. The eluting buffer was composed of 0.05 M phosphate and 0.002 M tetrabutylammonium hydroxide in 5% methyl cyanide, pH 7.0 at a flow rate of 1 ml/min. The K' values for $IO_3^-$, $IO_6^-$, $I^-$and $IO_4^-$under the conditions are 0, 1.57, 1.92 and 11.67, respectively.

F. Iodine-124 As a Radiopharmaceutical

The Iodine-124 can be produced as sodium-Iodine-124 and orally administered to a patient diagnosed with thyroid carcinoma. A 1 mCi to 5 mCi oral dose of ($I^{124}$)-iodide may be administered for tomographic imaging of the thyroid gland. Positron camera imaging can be used to evaluate the therapy. Other gamma radiation associated with the radioactive decay of Iodine-124 does not cause appreciable interference with imaging the positron annihilation photons.

Imaging of the thyroid can be accomplished at 4 to 24 hours after administration of the Iodine-124 iodide dose. If biopsy, or other clinical data indicate, a 100 to 200 mCi internal therapeutic dose of Iodine-131 could be administered for the purpose of destroying residual thyroid tissue after surgery. The low dose of Iodine-124 PET study aids in accurate estimation of thyroid function, and the anatomical and morphological structure involved. This allows more accurate dosing than is afforded by conventional imaging methods. Alternatively, a therapeutic dose of Iodine-124 could be used instead of Iodine-131. The absorbed radiation dosimetry for Iodine-124 is approximately 69% of that for a comparable quantity of Iodine-131. Therefore, Iodine-124 should be used primarily in patients suspected of having a diseased condition which, if clinically confirmed, would be subsequently treated with a radiotherapeutic dose of Iodine-124 or Iodine-131. Another feature of the use of Iodine-124 is that a diagnostic PET study could follow internal radioiodine therapy. Iodine-124 remaining in the patient can be used to tomographically establish the presence, if any, of residual thyroid tissue intended to be removed by surgery or internal radiation treatment.

Large quantities (150 mCi) of Iodine-124 can be routinely produced by the Tellurium-124 (d,2n) Iodine-124 reaction. The production yield data is given in Table 1. Iodine-124 can be produced in higher yields and final product purity by using this reaction rather than by the Tellurium-124 (p,n) Iodine-124 reaction. The yields for the Tellurium-124 (d,2n) Iodine-124 was 0.57 mCi per microampere hour, compared to 0.093 mCi per microampere hour for the Tellurium-124(p,n) Iodine-124 reaction reported in Kondo et al, 28 Int. J. App. Rad. and Isotopes, 765, (1977).

Another example of the use of Iodine-124 is in the diagnosis of tuberculoma. Isonicotinic acid hydrazide (INH) has been one of the most effective agents in tuberculosis therapy since 1952. The aromatic nucleus of INH can be labeled with I-124 to be used as a radiotracer for differential diagnosis of tuberculoma. 2-iodoisonicotinic acid (1.8 mg) was suspended in was (200 1) and 5N sodium hydroxide solution (100 1) was added and the vial was capped tightly, and heated at 140° C. for 2h. Then the solution was acidified with dilute hydrochloric acid until a faint precipitate appears. The solvents were removed with the aid of a steam of nitrogen and the resultant material was extracted with methanol (3×500) 1). This methanol solution was treated with diazomethane until a persistent yellow color appears. The solvents were evaporated and the residue was dissolved in ethanol (100 1): and heated to boil. Then hydrazine hydrate (20 1) was added and after 1 minute, the reaction mixture was analyzed by HPLC using carbon-18 reverse phase column, with acetonitrile: water (40v:60v) as the eluent. Retention time of free $^{124}$I-Iiodide, $^{124}$I-2-iodomethylisonicotinate and $^{124}$I-2-iodoisonicotinic acid hydrazide were 2.34, 12.32, and 3.01 minutes respectively. Overall radiochemical yield was 16% and the time spent for chemical manipulations was 3.5 hours. Biodistribution studies can then be conducted.

Iodine-124 of the present invention is intended for use in a wide variety of radiopharmaceutical applications. Such uses include synthesis of organic compounds with Iodine-124. The purity of the Iodine-124 solutions of the present invention greatly facilitate the production of such products. For example, one can make biologically active cell-specific or receptor-specific compounds that are selectively sequestered at desired tissue sites without rise of in vivo release of the radionuclide from its carrier.

Iodine-124 can be incorporated into a cell-specific binding agent, as an unsaturated organic linker, and may be used directly as a radiopharmaceutical or may be covalently bonded to monoclonal antibodies Iodine-124 prepared in accordance with this invention may be provided in a kit usable by a physician, pharmacist, or researcher to prepare radiopharmaceuticals to their own specifications.

Specific examples of possible uses include incorporating Iodine-124 into a steroid group, an aryl group, a substituted aryl group, a vinyl group, or an aryl group capable of coupling with antibodies.

Similarly, Iodine-124 can be incorporated into an aromatic amine, an aromatic isocyanate, an aromatic carboxylic acid, and aromatic isothiocyanate, benzoic acid, a substituted benzoic acid group, or a vinylestradial group.

Alternatively, the Iodine-124 can be combined with non-cell selective compounds, such as styrenes or styrene polymers that can be formed into a colloidal dispersion or particulate form and then used for radiation synovectomy in the treatment of rheumatoid arthritis.

In addition, the Iodine-124 produced in accordance with the present invention can be incorporated into iodinated organic compounds such as steroids, cholesterol and estrogen derivatives and hormones.

In summary, this invention is a reliable method for obtaining greater than 100 millicurie quantities of Iodine-124 in greater than 99.5% radionuclide purity via bombardment of isotopically enriched Tellurium-124. The Iodine-124 has physical properties that are useful for diagnostic and therapeutic radiopharmaceuticals, particularly when used in conjunction with positron emission tomography. Furthermore, there is also interest in using Iodine-124 as a radioactive standard.

The foregoing detailed description has been given for illustration purposes only. A wide range of changes and modifications can be made to the preferred embodiment described above. It should, therefore, be understood that it is the following claims, including all equivalents, which are intended to define the scope of this invention.

We claim:

1. A method of producing Iodine-124, said method comprising:

placing a target means comprising copper in a nickel plating solution and electroplating said target means with nickel;

placing the resulting target means in an isotopically enriched Tellurium-124 dioxide plating solution and electroplating said target means with Tellurium-124;

placing the resulting target means in line with a deuteron beam of a cyclotron, thereby irradiating the Tellurium-124 and creating Iodine-124 by the $^{124}Te(d,2n)^{124}I$ reaction; and separating the Iodine-124 from the target means.

2. The method of producing Iodine-124 of claim 1 wherein:

the target means is a copper metal plate which is first milled and uniformly lapped, said copper metal plate being sanded, washed with distilled water, and dried prior to electroplating.

3. The method of producing Iodine-124 of claim 2 wherein:

Tellurium-124 electroplating is accomplished by means of a solution of isotopically enriched Tellurium-124 dioxide dissolved in a solution of potassium hydroxide and by means of a platinum electrode.

4. The method of producing Iodine-124 of claim 3 wherein:

the target thickness is between 10 and 14 milligrams per square centimeter.

5. The method of producing Iodine-124 of claim 1 wherein the irradiated target is placed in a solution of sodium hydroxide solution containing hydrogen peroxide and water, subsequently, the solution is transferred to a vessel containing aluminum powder, thereafter the solution so purged with air, then carbon dioxide gas, particles in the solution are then filtered out and passed through a cation-exchange column.

6. The method of making Iodine-124 in claim 1 whereby:

the Iodine-124 is used as a radioactive standard for nuclear detection calibration.

7. A method of synthesizing Iodine-124 labeled meta-iodobenzylguanidine, said method comprising:

placing a target means comprising copper in a nickel plating solution and electroplating said target means with nickel;

placing the resulting target means in a Tellurium-124 plating solution and electroplating said target means with Tellurium-124;

placing the resulting target means in line with the particle beams of a cyclotron, thereby irradiating the Tellurium-124 and creating Iodine-124;

separating the Iodine-124 from the target means; and combining the Iodine-124 with meta-iodobenzylguanidine.

8. The method of claim 7 wherein the Iodine-124 is combined with the meta-iodobenzylguanidine in a method comprising the mixing of meta-iodobenzylguanidine sulphate with copper nitrate in a borosilicate serum vial, adjusting the pH to about 5, heating the solution to 150 degrees centigrade, cooling, adding a sodium biphosphate buffer solution, and passing the filtrate through an anion-exchange resin.

9. A method of synthesizing Iodine-124 to a purity of about 99.5%, said method comprising:

creating a target matrix by electroplating Tellurium-124 onto a nickel surface of a water cooled copper plate, whereby the resulting Tellurium-124 concentration is at least 0.1 milligrams per square centimeter, bombarding the electroplated tellurium for about four hours with a 50 microampere beam current comprising deuteron particles having a particle energy of at least 6.5 MeV, thereby producing an Iodine-124 product, allowing said iodine product to decay for about 40 hours, and separating Iodine-124 from the target matrix.

10. The method of synthesizing Iodine-124 of claim 9 whereby:

the Tellurium-124 concentration of the target matrix is about 10 to 14 milligrams per square centimeter.

11. The method of synthesizing Iodine-124 of claim 10 whereby:

the resulting Iodine-124 is incorporated into a substance selected from the group including the following: a steroidal group, an aryl group, a substituted aryl group, a vinyl group, an aryl group capable of coupling with antibodies, an aromatic amine, an aromatic isocyanate, benzoic acid, a substituted benzoic group, a vinylestradial group, monoclonal antibodies, polyclonal antibodies, steroids, cholesterol derivatives, estrogen derivatives, hormones, and proteins.

12. The method of making Iodine-124 of claim 9 wherein:

irradiation is conducted in the range of 25 to 80 microamperes deuteron beam current with irradiation doses ranging from 100 to 500 microampere hours.

13. A method of making and purifying an Iodine-124 solution comprising the steps of:

disposing on a target means a substantial amount of Tellurium-124, irradiating said Tellurium-124 and transforming a substantial amount of said Tellurium-124 into Iodine-124 by the $^{124}Te(d,2n)^{124}I$ reaction, chemically removing said Iodine-124 from said target means to produce a solution having radioisotopes of iodine which are primarily Iodine-124, removing from said solution a substantial portion of deleterious salts, whereby autoradiolytic decomposition of said Iodine-124 is substantially reduced.

14. A method of making and purifying an Iodine-124 solution in accordance with claim 13 wherein said step of removing salts from said solution includes:

preparing an ion exchange column and passing said solution through said column, and heating said solution to reduce the volume so that its final concentration is about 15 to 120 mCi per 1.0 ml or greater specific activity.

15. A method of making and purifying an Iodine-124 solution in accordance with claim 13 wherein:

said Iodine-124 is separated from trace Tellurium, and said solution is subsequently purified by removing salts from said solution by preparing an ion exchange column and passing said solution through said column, and heating said solution to reduce its volume so that its concentration is about 15 to 120 mCi per 1.0 ml. or greater specific activity.

* * * * *